US011149966B2

(12) United States Patent
Shishido et al.

(10) Patent No.: US 11,149,966 B2
(45) Date of Patent: Oct. 19, 2021

(54) INDOOR UNIT OF AIR-CONDITIONING APPARATUS

(71) Applicant: Mitsubishi Electric Corporation, Tokyo (JP)

(72) Inventors: Takahiro Shishido, Tokyo (JP); Mitsuhiro Shirota, Tokyo (JP); Shogo Namatame, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 47 days.

(21) Appl. No.: 16/473,357

(22) PCT Filed: Mar. 9, 2017

(86) PCT No.: PCT/JP2017/009521
§ 371 (c)(1),
(2) Date: Jun. 25, 2019

(87) PCT Pub. No.: WO2018/163360
PCT Pub. Date: Sep. 13, 2018

(65) Prior Publication Data

US 2020/0124294 A1 Apr. 23, 2020

(51) Int. Cl.
*F24F 1/0011* (2019.01)
*F24F 13/20* (2006.01)

(52) U.S. Cl.
CPC ..... *F24F 1/0011* (2013.01); *F24F 13/20* (2013.01)

(58) Field of Classification Search
CPC ..... F24F 1/0007; F24F 1/0011; F24F 1/0025; F24F 1/0057; F24F 1/0073; F24F 11/79; F24F 13/20; F24F 2221/28
See application file for complete search history.

(56) References Cited

U.S. PATENT DOCUMENTS 4,326,452 A * 4/1982 Nawa ..... F15D 1/08 454/258
4,516,483 A * 5/1985 Bosman ..... F24F 13/072 454/301

(Continued)

FOREIGN PATENT DOCUMENTS

CN 101261031 A 9/2008
CN 103363633 A 10/2013

(Continued)

OTHER PUBLICATIONS

WO-2005008139-English_abstract.pdf (Year: 2005).*

(Continued)

*Primary Examiner* — Jianying C Atkisson
*Assistant Examiner* — Jose O Class-Quinones
(74) *Attorney, Agent, or Firm* — Posz Law Group, PLC

(57) ABSTRACT

An indoor unit of an air-conditioning apparatus includes a casing with air inlet and air outlet. A heat exchanger in the casing exchanges heat with air sucked through the air inlet, an air-sending fan blows the heat exchanged air through the air outlet, and a vertical air-directing plate in the air outlet sets a vertical air flow direction in which the heat exchanged air is blown. The casing has a front panel, a bottom panel, and a forward-facing panel connected to the bottom panel at an angle. The air outlet extends from the bottom panel to the forward-facing panel; a lower corner at which joins the bottom panel and an air-outlet side walk; and a forward-facing corner joins the forward-facing panel and the air-outlet side wall. The lower corner and the forward-facing corner each have an edge removed. A forward-facing corner edge-removal dimension smaller than a lower corner edge-removal dimension.

5 Claims, 5 Drawing Sheets

(56) References Cited

U.S. PATENT DOCUMENTS 4,556,172 A * 12/1985 Sugawara ..... F15D 1/08 239/590.5
4,607,565 A * 8/1986 Sugawara ..... F24F 13/075 454/319
4,738,116 A * 4/1988 Himeno ..... F24F 11/30 62/186
5,547,018 A * 8/1996 Takahashi ..... F24F 1/0011 165/267
5,575,326 A * 11/1996 Asami ..... F24F 1/0057 165/124
5,771,708 A * 6/1998 Suzuki ..... F24F 1/0011 62/285
6,062,032 A * 5/2000 Yoon ..... F24F 13/222 62/285
2004/0152411 A1* 8/2004 Gehring ..... F24F 13/06 454/153
2006/0211365 A1* 9/2006 Petrovic ..... F24F 13/078 454/261
2008/0220713 A1* 9/2008 Kim ..... F24F 1/0007 454/339
2009/0013715 A1* 1/2009 Setoguchi ..... F25B 5/02 62/524
2009/0090125 A1* 4/2009 Seki ..... F24F 11/79 62/407
2009/0158765 A1* 6/2009 Ooishi ..... F24F 13/20 62/263
2010/0126206 A1* 5/2010 Park ..... F24F 7/007 62/419
2010/0287973 A1* 11/2010 Son ..... F24F 1/0057 62/407
2011/0048050 A1* 3/2011 Moteki ..... F24F 1/0057 62/263
2011/0113807 A1* 5/2011 Kojima ..... F24F 1/0007 62/262
2013/0129515 A1* 5/2013 Park ..... F04D 29/283 416/223 R
2013/0255909 A1* 10/2013 Matsumoto ..... B60H 1/00814 165/11.1
2014/0134939 A1* 5/2014 Kamada ..... F24F 13/10 454/309
2014/0315482 A1* 10/2014 Yasutomi ..... F24F 1/0057 454/338
2016/0327297 A1* 11/2016 Song ..... F24F 1/005

FOREIGN PATENT DOCUMENTS

EP 1744106 A1 * 1/2007 ..... F04D 29/663
EP 2184553 A1 * 5/2010 ..... F24F 11/79
EP 2796801 A1 * 10/2014 ..... F24F 13/20
JP S62-010553 A 1/1987
JP 2013-053796 A 3/2013
WO WO-2005008139 A1 * 1/2005 ..... F24F 1/0007
WO WO-2010056001 A1 * 5/2010 ..... F24F 1/0057

OTHER PUBLICATIONS

Office Action dated Mar. 1, 2021 issued in corresponding CN application No. 201780084114.0 (and English machine translation).

* cited by examiner

INDOOR UNIT OF AIR-CONDITIONING APPARATUS

CROSS REFERENCE TO RELATED APPLICATION

This application is a U.S. national stage application of International Application No. PCT/JP2017/009521, filed on Mar. 9, 2017, the contents of which are incorporated herein by reference.

TECHNICAL FIELD

The present invention relates to an indoor unit of an air-conditioning apparatus, and in particular, relates to a structure of an air outlet.

BACKGROUND

Air-conditioning apparatuses include indoor units, each of which typically includes a fan disposed in an air passage extending from an air inlet to an air outlet, a heat exchanger disposed around the fan, and air-directing plates supported in proximity to the air outlet in such a manner that the air-directing plates are rotatable. The direction of conditioned air to be blown through the air outlet is changed vertically by a vertical air-directing plate and is changed horizontally by a horizontal air-directing plate. Some of such indoor units of air-conditioning apparatuses are configured in such a manner that a front panel of a casing has a rounded shape and each side wall of an air outlet extends outward at a boundary between the air outlet and a design surface of the indoor unit (refer to Patent Literature 1, for example).

PATENT LITERATURE

Patent Literature 1: Japanese Unexamined Patent Application Publication No. 2013-53796

In the indoor unit of the air-conditioning apparatus disclosed in Patent Literature 1, each side wall of the air outlet has a sectional shape including linear part and outwardly extending to lower part of a front surface of a body of the indoor unit. Such a configuration causes conditioned air blown through the air outlet to flow along the shapes of corners of the air outlet and spread outward, or rightward and leftward, from the indoor unit due to the Coanda effect. This action results in a reduction in flow rate of air flowing in a forward direction from the indoor unit, leading to a reduction in air flow reach in the forward direction. This result may reduce the comfort of a user in front of the indoor unit.

A configuration in which the design surface and the air-outlet side wall join at a right angle at each corner of the air outlet allows the spread of conditioned air in rightward and leftward directions to be smaller than that in the above-described configuration in which the corners of the air outlet extend outward. The air outlet with such a configuration increases the flow rate of air flowing in the forward direction, leading to an increase in air flow reach in the forward direction. However, this air outlet reduces the flow rate of air flowing in the rightward and leftward directions, leading to a reduction in air flow reach in the rightward and leftward directions. This reduction may reduce the comfort of users on the right and left sides of the indoor unit.

SUMMARY

The present invention has been made to overcome the above-described disadvantages, and aims to provide an air-conditioning-apparatus indoor unit that has improved air flow reachability in forward, rightward, and leftward directions from the indoor unit.

An air-conditioning-apparatus indoor unit according to an embodiment of the present invention includes a casing having an air inlet and an air outlet, a heat exchanger disposed in the casing and exchanging heat with air sucked through the air inlet, an air-sending device configured to cause the air subjected to heat exchange by the heat exchanger to be blown through the air outlet, and a vertical air-directing plate disposed in the air outlet, the vertical air-directing plate being vertically rotatable to set a vertical air flow direction in which the air subjected to heat exchange by the heat exchanger is blown. The casing has a forward-facing surface defined by a front panel and a bottom surface defined by a bottom panel. The front panel and the bottom panel are connected by a forward-facing panel connected to the bottom panel at a right angle or an obtuse angle. The air outlet extends from the bottom panel to the forward-facing panel and includes a lower corner at which the bottom panel and an air-outlet side wall join together and a forward-facing corner at which the forward-facing panel and the air-outlet side wall join together. The lower corner and the forward-facing corner each have an edge removed to have an edge-removal dimension of the forward-facing corner that is smaller than an edge-removal dimension of the lower corner.

In the air-conditioning-apparatus indoor unit according to an embodiment of the present invention, the lower corner, which has an edge removed, of the air outlet causes blown conditioned air to flow along the shape of the corner and spread rightward or leftward due to the Coanda effect, thus allowing the blown air to reach a distant area in a rightward or leftward direction. In addition, the edge-removal dimension of the forward-facing corner of the air outlet is the edge-removal dimension of the lower corner. This arrangement allows the spread of the blown conditioned air in the rightward or leftward direction to be smaller than that in a configuration in which the forward-facing corner and the lower corner each have an edge removed into the same shape, resulting in an increase in flow rate of air flowing in a forward direction. This configuration allows the blown air to reach a distant area in the forward direction. As described above, the air-conditioning-apparatus indoor unit according to an embodiment of the present invention including the above-described lower and forward-facing corners has improved direction controllability of air flowing in the rightward and leftward directions as well as improved air flow reachability in the rightward, leftward, and forward directions.

DETAILED DESCRIPTION

An air-conditioning apparatus 1 according to Embodiment 1 of the present invention will be described with reference to the drawings.

Embodiment 1

Figure 1:
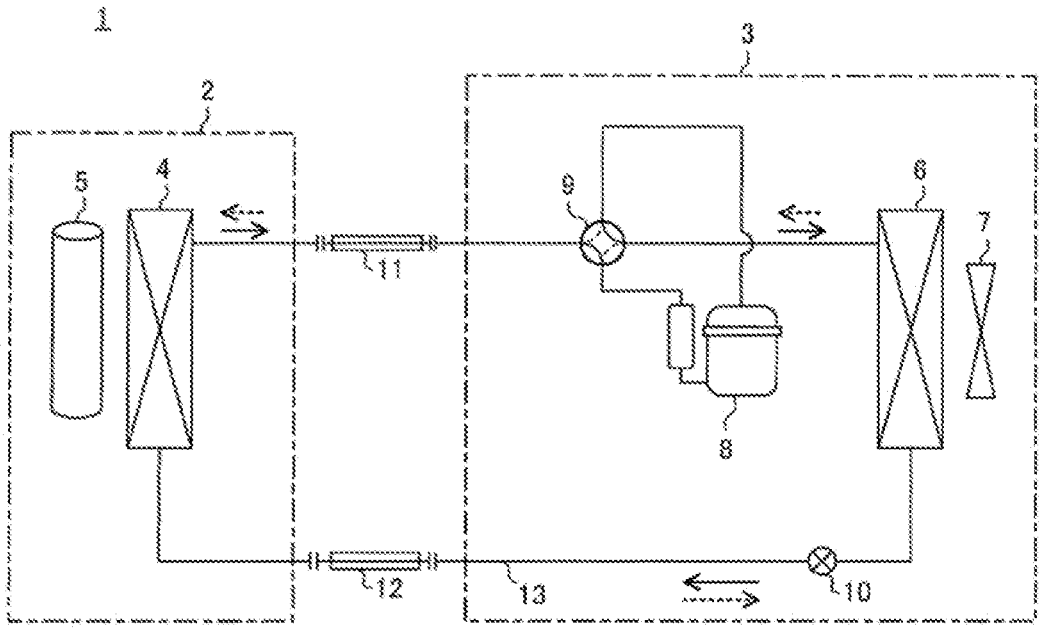
FIG. 1 is a schematic diagram of a refrigerant circuit of an air-conditioning apparatus according to Embodiment 1 of the present invention.

FIG. 1 is a schematic diagram of a refrigerant circuit of the air-conditioning apparatus according to Embodiment 1 of the present invention. As illustrated in FIG. 1, the air-conditioning apparatus 1 includes an indoor unit 2 and an outdoor unit 3. The indoor unit 2 includes an indoor heat exchanger 4 and an indoor air-sending device 5. The outdoor unit 3 includes an outdoor heat exchanger 6, an outdoor air-sending device 7, a compressor 8, a four-way switching valve 9, and an expansion valve 10. The indoor unit 2 and the outdoor unit 3 are connected to each other by a gas connecting pipe 11 and a liquid connecting pipe 12, thus forming a refrigerant circuit 13.

In the air-conditioning apparatus 1, switching between passage states of the four-way switching valve 9 switches between a cooling operation and a heating operation. FIG. 1 illustrates a passage state of the four-way switching valve 9 in the cooling operation of the air-conditioning apparatus 1. Solid line arrows represent a refrigerant flow direction in the cooling operation, whereas dotted line arrows represent a refrigerant flow direction in the heating operation in FIG. 1.

Figure 2:
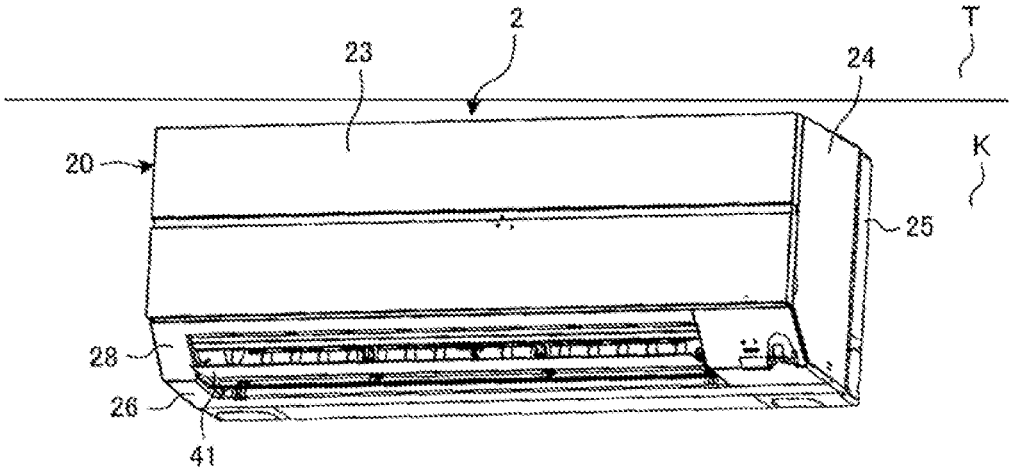
FIG. 2 is a perspective view illustrating an indoor unit of the air-conditioning apparatus according to Embodiment 1 of the present invention.
Figure 3:
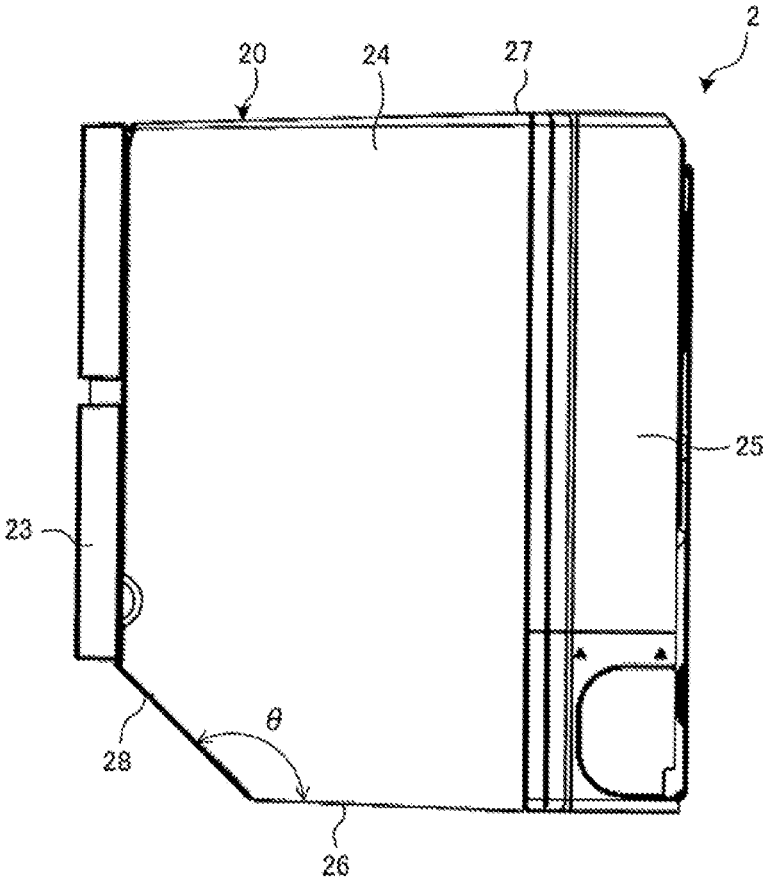
FIG. 3 is a side elevational view of the indoor unit of the air-conditioning apparatus according to Embodiment 1 of the present invention.
Figure 4:
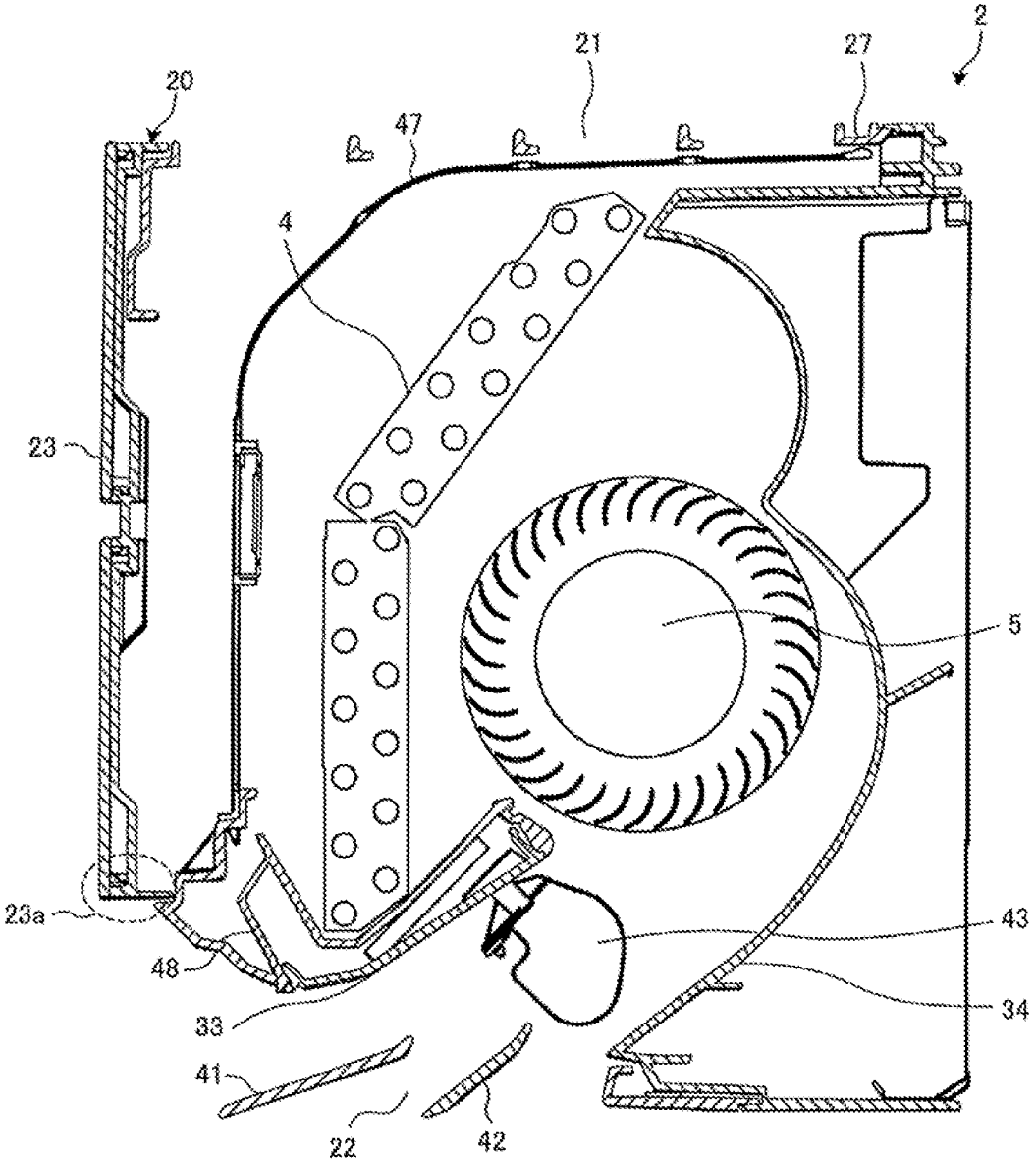
FIG. 4 is a cross-sectional view illustrating an internal configuration of the indoor unit of the air-conditioning apparatus according to Embodiment 1 of the present invention.

A schematic configuration of the indoor unit 2 will be described below with reference to FIGS. 2 to 4. FIG. 2 is a perspective view of the indoor unit of the air-conditioning apparatus according to Embodiment 1 of the present invention. FIG. 3 is a side elevational view of the indoor unit of the air-conditioning apparatus according to Embodiment 1 of the present invention. FIG. 4 is a cross-sectional view illustrating an internal configuration of the indoor unit of the air-conditioning apparatus according to Embodiment 1 of the present invention.

The indoor unit 2 includes a casing 20, the indoor heat exchanger 4, and the indoor air-sending device 5. The indoor heat exchanger 4 and the indoor air-sending device 5 are arranged in the casing 20. The indoor unit 2 is installed in an air-conditioned space. FIG. 2 illustrates the indoor unit 2 of a wall-mounted type as an example. In the following description, the term "rear surface" refers to a surface of the indoor unit 2 adjacent to a wall face K in FIG. 2, the term "front surface" refers to a surface opposite the rear surface, the term "top surface" refers to a surface of the indoor unit 2 adjacent to a ceiling face T, the term "bottom surface" refers to a surface opposite the top surface, the term "right side" refers to a side of the indoor unit 2 on the right of FIG. 2, and the term "left side" refers to a side opposite the right side. For air flow directions, the term "upward" as used herein refers to a direction toward the top surface, the term "downward" refers to a direction toward the bottom surface, the term "forward" refers to a direction toward the front surface, the term "rearward" refers to a direction toward the rear surface, the term "leftward" refers to a direction toward the left side, and the term "rightward" refers to a direction toward the right side.

The front surface of the casing 20 is covered mainly by a front panel 23, the right and left sides of the casing 20 are covered by side panels 24, the rear surface of the casing 20 is covered by a rear panel 25, the top surface of the casing 20 is covered by a top panel 27, and the bottom surface of the casing 20 is covered by the rear panel 25 and a bottom panel 26. As illustrated in FIG. 4, the front panel 23 includes lower part (hereinafter, referred to as "front-panel lower part 23*a*"), which is bent toward the rear surface to have an L-shaped cross-section. As illustrated in FIG. 3, a forward-facing panel 28 is disposed under the front panel 23 of the casing 20. The forward-facing panel 28 is connected to the bottom panel 26. An angle θ formed by the forward-facing panel 28 and the bottom panel 26, serving as two faces, is an obtuse angle. The forward-facing panel 28 may be connected to the bottom panel 26 in such a manner that the angle θ is a right angle.

The casing 20 has an air inlet 21 located in upper part and an air outlet 22 located in lower part, and defines an air passage connecting the air inlet 21 and the air outlet 22. The air inlet 21 includes openings in a lattice pattern arranged in the top panel 27 of the casing 20. The air outlet 22 extends from the bottom panel 26 to the forward-facing panel 28. As illustrated in FIGS. 2 to 4, the air outlet 22 includes inner walls defined by an air-outlet upper surface 33, an air-outlet bottom surface 34, and air-outlet right and left side walls 35 (refer to FIG. 5). The air-outlet upper surface 33 and the air-outlet bottom surface 34 are, for example, gently curved surfaces shaped in such a manner that the air passage extends gradually upward toward the air outlet 22.

The indoor heat exchanger 4 exchanges heat between refrigerant circulating through the refrigerant circuit 13 and indoor air sucked through the air inlet 21. The indoor air-sending device 5 causes the air to enter through the air inlet 21, pass through the indoor heat exchanger 4 disposed around the indoor air-sending device 5, and then be blown through the air outlet 22. The indoor air-sending device 5 is, for example, a cross-flow fan, and is driven by, for example, a motor (not illustrated). A filter 47 for removing dust from the air is disposed upstream of the indoor heat exchanger 4 in an air flow direction in the air passage. A drain pan 48 for receiving drain water from the indoor heat exchanger 4 is disposed under the indoor heat exchanger 4.

The indoor unit 2 further includes an air flow direction adjusting mechanism for adjusting the direction in which the indoor air (hereinafter, referred to as "conditioned air") conditioned by the indoor heat exchanger 4 is blown. As illustrated in FIG. 4, the air flow direction adjusting mechanism includes a vertical air-directing plate 41, an auxiliary vertical air-directing plate 42, and a horizontal air-directing plate 43.

Each of the vertical air-directing plate 41 and the auxiliary vertical air-directing plate 42 extends in a longitudinal direction (horizontal direction) of the air outlet 22, and vertically changes the direction of the conditioned air to be blown through the air outlet 22. The vertical air-directing plate 41 and the auxiliary vertical air-directing plate 42 open and close the air outlet 22. The vertical air-directing plate 41 is supported in proximity to the air outlet 22 by a vertical air-directing support (not illustrated) in such a manner that the vertical air-directing plate 41 is rotatable about the axis of rotation of the vertical air-directing plate 41. The auxiliary vertical air-directing plate 42 is also supported in proximity to the air outlet 22 by an auxiliary vertical air-directing support (not illustrated) in such a manner that the auxiliary vertical air-directing plate 42 is rotatable about the axis of rotation of the auxiliary vertical air-directing plate 42. The vertical air-directing plate 41 and the auxiliary vertical air-directing plate 42 are driven by, for example, motors (not illustrated). A controller (not illustrated) controls driving of the motors. The vertical air-directing plate 41 and the auxiliary vertical air-directing plate 42 constitute parts of a design surface of the indoor unit 2 when the vertical air-directing plate 41 and the auxiliary vertical air-directing plate 42 close the air outlet 22.

The horizontal air-directing plate 43 includes a plurality of air-directing plate elements arranged in the longitudinal direction (horizontal direction), and horizontally changes the direction of the conditioned air to be blown through the air outlet 22. The air-directing plate elements are arranged on the air-outlet upper surface 33 of the air outlet 22 in such a manner that the air-directing plate elements are rotatable from side to side. The air-directing plate elements are coupled to each other by a coupling rod. The horizontal air-directing plate 43 is driven by, for example, a motor (not illustrated). The controller (not illustrated) controls driving of the motor.

The flow of air in the indoor unit 2 during an operation of the air-conditioning apparatus 1 will be described below in brief. The indoor air sucked through the air inlet 21 by the indoor air-sending device 5 is subjected to dust removal through the filter 47 and is then supplied to the indoor heat exchanger 4. The air supplied to the indoor heat exchanger 4 exchanges heat with the refrigerant while passing through the indoor heat exchanger 4. The air is cooled in the cooling operation or is heated in the heating operation and then serves as conditioned air. The conditioned air reaches the indoor air-sending device 5. The conditioned air passes through the indoor air-sending device 5 or a gap between the indoor air-sending device 5 and the air-outlet bottom surface 34. The direction of the air to be blown is adjusted by the air flow direction adjusting mechanism. The air is blown to the air-conditioned space through the air outlet 22.

Figure 5:
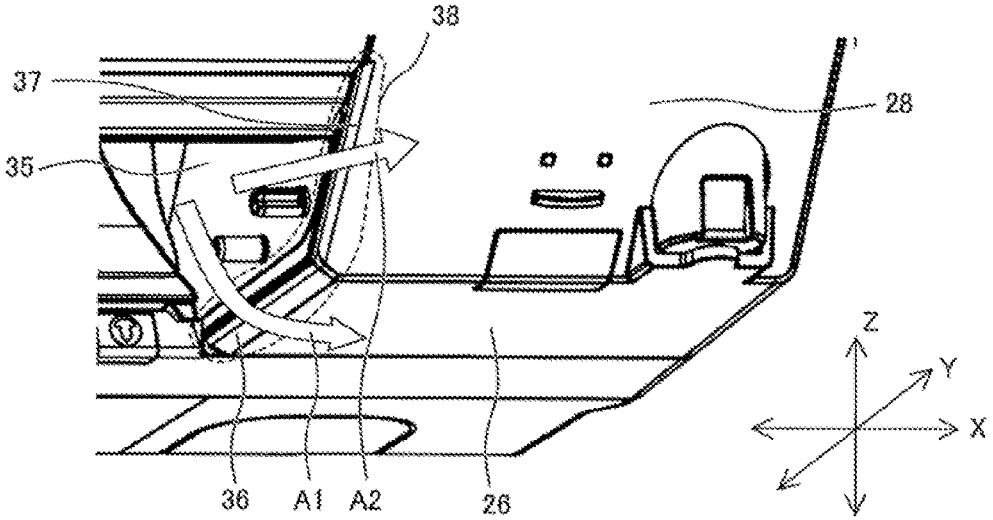
FIG. 5 is an enlarged perspective view of part including an air-outlet corner of the indoor unit of the air-conditioning apparatus according to Embodiment 1 of the present invention.
Figure 6:
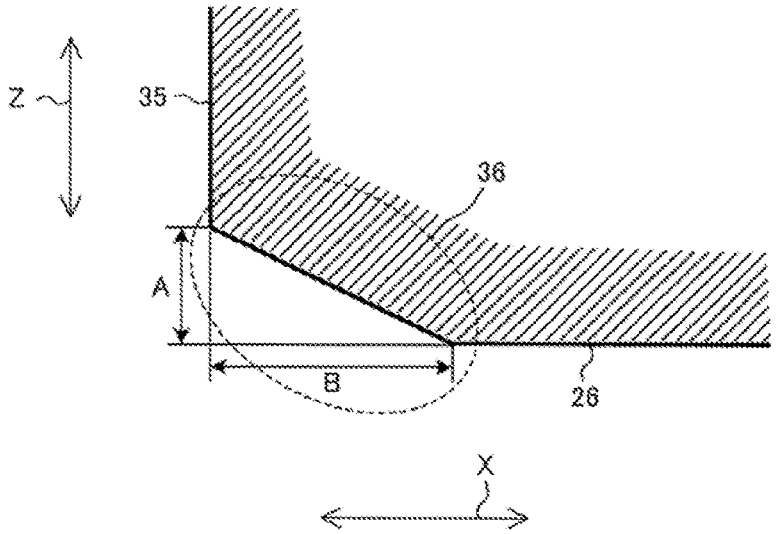
FIG. 6 is a fragmentary sectional view of part including a lower corner of an air outlet of the indoor unit of the air-conditioning apparatus according to Embodiment 1 of the present invention.
Figure 7:
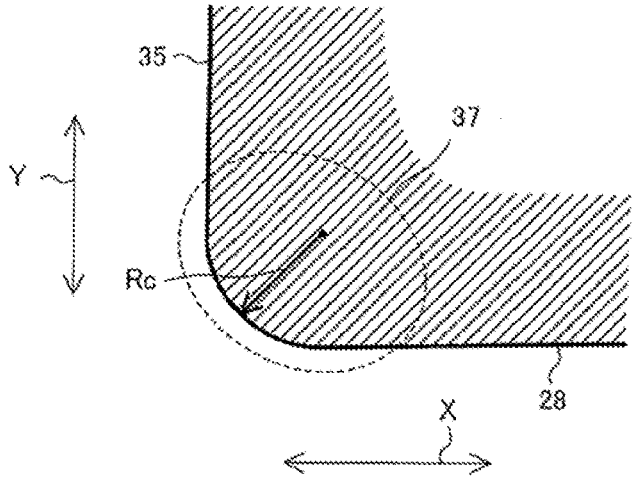
FIG. 7 is a fragmentary sectional view of part including a forward-facing corner of the air outlet of the indoor unit of the air-conditioning apparatus according to Embodiment 1 of the present invention.

A structure of each corner (hereinafter, referred to as an "air-outlet corner 38") of the air outlet 22 will be described below with reference to FIGS. 5 to 7. FIG. 5 is an enlarged perspective view of part including the air-outlet corner of the indoor unit of the air-conditioning apparatus according to Embodiment 1 of the present invention. FIG. 6 is a fragmentary sectional view of part including a lower corner of the air outlet of the indoor unit of the air-conditioning apparatus according to Embodiment 1 of the present invention. FIG. 7 is a fragmentary sectional view of part including a forward-facing corner of the air outlet of the indoor unit of the air-conditioning apparatus according to Embodiment 1 of the present invention. In FIGS. 5 to 7, arrows X, Y, and Z represent a right-left direction, a front-rear direction, and an up-down direction in the air-conditioning apparatus 1, respectively.

As illustrated in FIG. 5, parts on the right and left sides of the air outlet 22 are defined by two faces as the forward-facing panel 28 and the bottom panel 26, and are connected to the air-outlet side walls 35, serving as the inner walls of the air outlet 22. Specifically, the air outlet 22 includes lower corners 36, at each of which the air-outlet side wall 35 and the bottom panel 26 join together, and forward-facing corners 37, at each of which the air-outlet side wall 35 and the forward-facing panel 28 join together.

The lower corners 36 and the forward-facing corners 37 of the air outlet 22 are subjected to edge removal to each have an edge removed. Examples of edge removal include chamfering to provide an angled cross-sectional shape, rounding to provide a rounded cross-sectional shape, and combination of chamfering and rounding. Each air-outlet corner 38 is shaped to have the edge removed to have an edge-removal dimension of the forward-facing corner 37 that is smaller than an edge-removal dimension of the lower corner 36. As regards edge removal for the lower corner 36 and the forward-facing corner 37, for example, both of them may be rounded or chamfered, or alternatively, one of them may be rounded and the other may be chamfered. The term "edge-removal dimension" as used herein refers to the lengths of removed sides of a chamfered edge or the radius of curvature of a rounded edge.

As described above, each air-outlet corner 38 has the edge removed to have an edge-removal dimension at the forward-facing panel 28 that is smaller than an edge-removal dimension at the bottom panel 26. This shape causes conditioned air A1 blown downward at the air-outlet corners 38 to spread rightward and leftward (in the arrow X direction) along the shapes of the lower corners 36 due to the Coanda effect. The forward-facing corners 37, which have a smaller edge-removal dimension than the lower corners 36, hinder conditioned air A2 blown forward at the air-outlet corners 38 from spreading rightward and leftward. Consequently, the indoor unit 2 provides the conditioned air A1 in rightward and leftward directions, and increases the flow rate of air flowing forward to improve air flow reachability in a forward direction.

FIG. 6 illustrates an exemplary section of one of the edge-removed lower corners 36 in the XZ plane. As illustrated in FIG. 6, when the lower corners 36 are chamfered, each of the lower corners 36 is preferably chamfered to have an edge-removal dimension A along one of the air-outlet side walls 35 and an edge-removal dimension B along the bottom panel 26 that is greater than the edge-removal dimension A. The lower corner 36 chamfered as described above provides a greater range of rightward and leftward spread of the downwardly blown conditioned air A1 than those provided by a lower corner in which the edge-removal dimension A equals the edge-removal dimension B and a lower corner in which the edge-removal dimension B is smaller than the edge-removal dimension A. This shape results in improved air flow reachability in the rightward and leftward directions.

FIG. 7 illustrates an exemplary section of one of the edge-removed forward-facing corners 37 in the XY plane. In FIG. 7, one of the forward-facing corners 37 is rounded to form a curved face having a radius of curvature Rc disposed between one of the air-outlet side walls 35 and the forward-facing panel 28. For example, the air-outlet corner 38 including the chamfered lower corner 36 illustrated in FIG. 6 and the rounded forward-facing corner 37 having the radius of curvature Rc smaller than the dimension of a chamfer of the lower corner 36 contributes to improvement of the air flow reachability in the forward, rightward, and leftward directions.

For a chamfer in which two removed sides differ in length as illustrated in FIG. 6, the dimension of the chamfer is represented by using the lengths of the removed sides, for example, the edge-removal dimension A and the edge-removal dimension B. In comparison between the edge-removal dimension of the lower corner 36 and the edge-removal dimension of the forward-facing corner 37, either one or both of the edge-removal dimensions of the two sides are used as the dimension of the chamfer. For example, when the edge-removal dimension of the rounded forward-facing corner 37 is smaller than the edge-removal dimension of the chamfered lower corner 36, it means that the radius of curvature Rc is smaller than either one or both of the edge-removal dimension A and the edge-removal dimension B.

Figure 8:
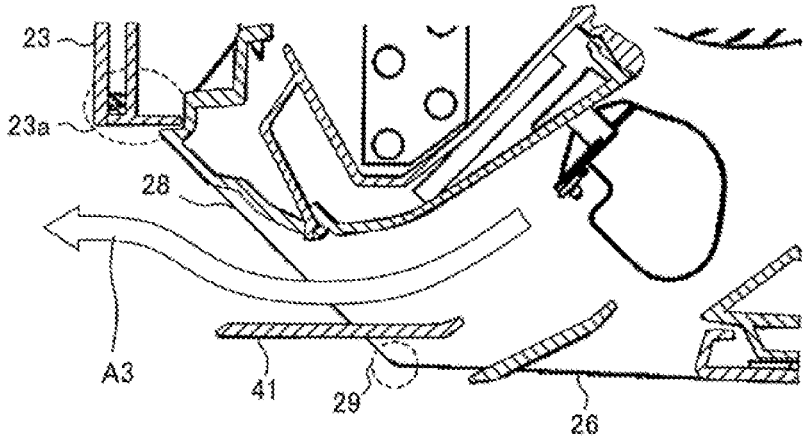
FIG. 8 is a sectional view of part including the air outlet when an air flow direction is set upward in the indoor unit of the air-conditioning apparatus according to Embodiment 1 of the present invention.
Figure 9:
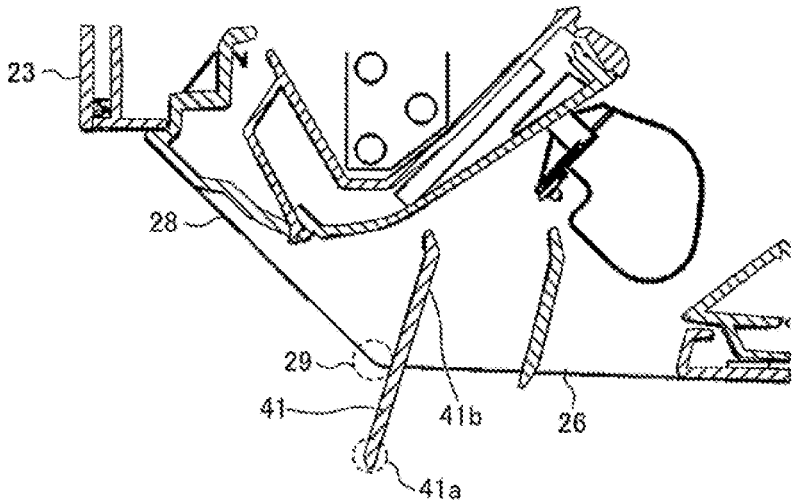
FIG. 9 is a sectional view of part including the air outlet when the air flow direction is set downward in the indoor unit of the air-conditioning apparatus according to Embodiment 1 of the present invention.

The position of the vertical air-directing plate 41 and an air flow in a case where the direction of air to be blown is set upward or downward will be described below with reference to FIGS. 8 and 9. FIG. 8 is a sectional view of part including the air outlet when an air flow direction is set upward in the indoor unit of the air-conditioning apparatus according to Embodiment 1 of the present invention. FIG. 9 is a sectional view of part including the air outlet when the air flow direction is set downward in the indoor unit of the air-conditioning apparatus according to Embodiment 1 of the present invention.

As illustrated in FIG. 8, when the air flow direction is set upward, the vertical air-directing plate 41 is positioned above a joint part 29 at which the bottom panel 26 and the forward-facing panel 28 join together. A main stream A3 of the blown conditioned air flows along upper part of the air outlet 22. As described above, the air-outlet upper surface 33 is a curved surface that extends upward, and the front-panel lower part 23*a* has an L-shaped cross-section. In this arrangement, the front-panel lower part 23*a* having the above-described L shape directs the main stream A3 of the blown conditioned air in the forward direction, thus increasing the flow rate of air flowing in the forward direction. This action results in improved air flow reachability in the forward direction.

The main stream A3 of the blown conditioned air passes by the above-described forward-facing corners 37 included in the right and left air-outlet corners 38 of the air outlet 22. Consequently, the flow rate of air flowing in the forward direction is further increased, resulting in an increase in air flow reach in the forward direction.

As illustrated in FIG. 9, when the air flow direction is set downward, a downstream end (hereinafter, referred to as a "downstream end 41*a*") of the vertical air-directing plate 41 is inclined downward. Specifically, the downstream end 41*a* of the vertical air-directing plate 41 is positioned below the joint part 29 at which the bottom panel 26 and the forward-facing panel 28 join together. A design surface 41*b* of the vertical air-directing plate 41 is partly located in the air passage. Part of the design surface 41*b* of the vertical air-directing plate 41 in the air passage is positioned closer to the rear surface than the joint part 29. In this arrangement, the vertical air-directing plate 41 and the auxiliary vertical air-directing plate 42 cause the main stream of the blown conditioned air to be directed downward in the air outlet 22. The main stream passes by the above-described lower corner 36 on the right of the air outlet 22 and that on the left of the air outlet 22. Consequently, this action results in an increase in air flow reach in the rightward and leftward directions of the conditioned air blown when the air flow direction is set downward, as represented by the conditioned air A1 illustrated in FIG. 5.

As described above, the indoor unit 2 of the air-conditioning apparatus 1 according to Embodiment 1 includes the casing 20 having the air inlet 21 and the air outlet 22, the heat exchanger (indoor heat exchanger 4) that is disposed in the casing 20 and exchanges heat with air sucked through the air inlet 21, the air-sending device (indoor air-sending device 5) that causes the air subjected to heat exchange in the heat exchanger (indoor heat exchanger 4) to be blown through the air outlet 22, and the vertical air-directing plate 41 that is disposed in the air outlet 22 and the vertical air-directing plate 41 is vertically rotatable to set the vertical air flow direction, in which the air subjected to heat exchange by the heat exchanger (indoor heat exchanger 4) is blown. The casing 20 has the forward-facing surface defined by the front panel 23 and the bottom surface defined by the bottom panel 26. The front panel 23 and the bottom panel 26 are connected by the forward-facing panel 28 connected to the bottom panel 26 at a right angle or an obtuse angle. The air outlet 22 extends from the bottom panel 26 to the forward-facing panel 28, and includes the lower corners 36, at each of which the air-outlet side wall 35 and the bottom panel 26 join together, and the forward-facing corners 37, at each of which the air-outlet side wall 35 and the forward-facing panel 28 join together. The lower corners 36 and the forward-facing corners 37 each have the edge removed. The forward-facing corner 37 has the edge-removal dimension, which is smaller than the edge-removal dimension of the lower corner 36.

In such a configuration, the edge-removed lower corners 36 of the air outlet 22 cause the blown conditioned air to spread in the rightward and leftward directions. The edge-removed forward-facing corners 37, which have a smaller edge-removal dimension than the lower corners 36, hinder the blown conditioned air from spreading in the rightward and leftward directions. Consequently, the indoor unit 2 achieves improvement in direction controllability of air flowing in the rightward and leftward directions with the lower corners 36 and the forward-facing corners 37, an increase in flow rate of air flowing in the forward direction, and improvement in air flow reachability in the rightward, leftward, and forward directions. As a result, the indoor unit 2 can provide comfortable air-conditioning to users on the right and left sides of the indoor unit 2 as well as a user in front of the indoor unit 2.

Each lower corner 36 is shaped to have the edge-removal dimension B along the bottom panel 26 that is greater than the edge-removal dimension A along one of the air-outlet side walls 35. This shape allows the indoor unit 2 to provide a greater range of spread of the blown conditioned air in the rightward and leftward directions than that provided in a case where each lower corner 36 of the air outlet 22 is shaped in such a manner that the edge-removal dimension at the bottom panel 26 is the same as the edge-removal dimension at one of the air-outlet side walls 35. This shape improves the air flow reachability in the rightward and leftward directions.

Each lower corner 36 has the edge chamfered to have an angled cross-sectional shape and each forward-facing corner 37 has the edge rounded to have a curved cross-sectional shape. Consequently, different processes to remove edges of the lower corner 36 and the forward-facing corner 37 can be used so that these corners have different cross-sectional shapes. This difference leads to improved workability in manufacture. For example, as the lower corner 36 is chamfered, the edge-removal dimension at the air-outlet side wall 35 may be set different from the edge-removal dimension at the bottom panel 26 to provide a desired angle of spread of conditioned air.

The lower part (front-panel lower part 23*a*) of the front panel 23 is bent toward the rear surface to have an L-shaped cross-section. Such a shape of the front-panel lower part 23*a* causes the conditioned air upwardly flowing along the air outlet 22 in the indoor unit 2 to be directed in the forward direction. Consequently, the indoor unit 2 increases the flow rate of air flowing in the forward direction, resulting in improved air flow reachability in the forward direction. In the aforementioned indoor unit of the air-conditioning apparatus disclosed in Patent Literature 1, the front panel has a rounded shape. In such an indoor unit, blown conditioned air upwardly spreads along the front panel having the above-described rounded shape due to the Coanda effect. This action results in a reduction in flow rate of air flowing in the forward direction from the indoor unit, leading to reduced air flow reachability in the forward direction. Furthermore, while an indoor unit including such a front panel is operating with a low air flow rate when an air flow direction is set upward, the performance of the indoor unit may be reduced due to a short cycle of air flow. In contrast, the indoor unit 2 reduces or eliminates a short cycle when the air flow direction is set upward by using the front-panel lower part 23*a*, thus improving the linearity of the blown conditioned air, or the air flow reachability.

When the air flow direction is set upward, the vertical air-directing plate 41 is positioned above the joint part 29 at which the bottom panel 26 and the forward-facing panel 28 join together. When the air flow direction is set downward, the downstream end 41*a* is positioned below the joint part 29 and the design surface 41*b* in the air passage is positioned rearward of the joint part 29.

In this arrangement, as the vertical air-directing plate 41 is positioned above the joint part 29, at which the bottom panel 26 and the forward-facing panel 28 of the casing 20 join together, when the air flow direction is set upward in the indoor unit 2, the main stream A3 of the blown conditioned air can be directed to pass by the forward-facing corners 37. In addition, as the downstream end 41*a* of the vertical air-directing plate 41 is positioned below the joint part 29 and the part of the design surface 41*b* of the vertical air-directing plate 41 in the air passage is positioned rearward of the joint part 29 when the air flow direction is set downward in the indoor unit 2, the main stream of the blown conditioned air can be directed to pass by the lower corners 36. As described above, the vertical air-directing plate 41 can be changed in position so that the position by which the conditioned air passes when the air flow direction is set upward differs from that when the air flow direction is set downward. Consequently, the indoor unit 2 achieves improvement in air flow reachability in the forward, rightward, and leftward directions while the indoor unit 2 is in operation.

Embodiments of the present invention are not limited to Embodiment 1 described above and various changes and modifications may be made. For example, each of the vertical air-directing plate and the auxiliary vertical air-directing plate may be divided into right and left elements and the right and left elements may be individually controlled.

The invention claimed is:

1. An indoor unit of an air-conditioning apparatus, the indoor unit comprising:

a casing having an air inlet and an air outlet;

a heat exchanger disposed in the casing, the heat exchanger exchanging heat with air sucked through the air inlet;

an air-sending fan configured to cause the air subjected to heat exchange by the heat exchanger to be blown through the air outlet; and a vertical air-directing plate disposed in the air outlet, the vertical air-directing plate being vertically rotatable to set a vertical air flow direction in which the air subjected to heat exchange by the heat exchanger is blown, the casing having a front panel disposed to a front surface, a bottom panel disposed to a bottom surface, and a forward-facing panel disposed under the front panel and connected to the bottom panel at a right angle or an obtuse angle, and the forward-facing panel including a right part and a left part defining right and left sides respectively of the air outlet, the air outlet extending from the bottom panel to the forward-facing panel and including a lower corner at which the bottom panel and an air-outlet side wall join together and a forward-facing corner at which the right part or the left part of the forward-facing panel and the air-outlet side wall join together, the lower corner and the forward-facing corner each having an edge removed to have an edge-removal dimension of the forward-facing corner that is smaller than an edge-removal dimension of the lower corner.

2. The indoor unit of claim 1, wherein the lower corner has the edge removed to have an edge-removal dimension A along the air-outlet side wall and an edge-removal dimension B along the bottom panel, the edge-removal dimension B being greater than the edge-removal dimension A.

3. The indoor unit of claim 1, wherein the lower corner has the edge chamfered to have an angled cross-sectional shape, and wherein the forward-facing corner has the edge rounded to have a curved cross-sectional shape.

4. The indoor unit of claim 1, wherein the front panel includes a lower part that has an L-shaped cross-section that is bent toward a rear surface of the indoor unit.

5. The indoor unit of claim 1, wherein when the vertical air flow direction is set upward, the vertical air-directing plate is positioned above a joint part at which the bottom panel and the forward-facing panel join together, and wherein when the vertical air flow direction is set downward, a downstream end of the vertical air-directing plate is positioned below the joint part and a design surface of the vertical air-directing plate in an air passage is positioned rearward of the joint part.

* * * * *